US006648101B2

(12) United States Patent
Kurtgis

(10) Patent No.: US 6,648,101 B2
(45) Date of Patent: Nov. 18, 2003

(54) FALL PROTECTION LANYARD APPARATUS

(76) Inventor: Michael P. Kurtgis, 4101 SW. 47th Ave., Suite 106, Ft. Lauderdale, FL (US) 33314

( * ) Notice: Subject to any disclaimer, the term of this patent is extended or adjusted under 35 U.S.C. 154(b) by 0 days.

(21) Appl. No.: 09/865,016

(22) Filed: May 24, 2001

(65) Prior Publication Data

US 2002/0175024 A1 Nov. 28, 2002

(51) Int. Cl.[7] ..... A47L 3/04

(52) U.S. Cl. ..... 182/3; 182/5; 182/7; 182/145; 244/137.4

(58) Field of Search ..... 182/3, 5, 8, 7, 182/142, 145, 150; 244/137.4

(56) References Cited

U.S. PATENT DOCUMENTS 3,696,471 A * 10/1972 Mermelstein ..... 24/193
4,253,544 A * 3/1981 Dalmaso ..... 182/3
4,426,957 A 1/1984 Horrigan
4,502,265 A 3/1985 Horrigan
4,673,059 A 6/1987 Kurtgis
4,762,257 A * 8/1988 Spillers et al. ..... 224/216
4,877,167 A * 10/1989 McNemar ..... 224/269
4,967,683 A * 11/1990 Brake et al. ..... 114/312
5,417,304 A 5/1995 Kurtgis
5,494,240 A * 2/1996 Waugh ..... 244/137.4
5,669,119 A * 9/1997 Seron ..... 24/265 H
6,056,242 A * 5/2000 Collins ..... 244/151 B
6,073,317 A * 6/2000 Barison ..... 24/115 F
6,164,048 A * 12/2000 Rhodes ..... 54/1
6,367,522 B1 * 4/2002 Tyer ..... 141/387
6,381,758 B1 * 5/2002 Roberts, II et al. ..... 2/421
6,390,234 B1 * 5/2002 Boyer ..... 182/3
6,457,556 B1 * 10/2002 Skade et al. ..... 182/8
6,467,573 B1 * 10/2002 Parker ..... 182/3
6,481,528 B2 * 11/2002 Antonio ..... 182/6

* cited by examiner

*Primary Examiner*—Bruce A. Lev
(74) *Attorney, Agent, or Firm*—Mark D. Bowen, Esq.; Stearns Weaver Miller Weissler Alhadeff & Sitterson, P.A.

(57) ABSTRACT

A fall protection lanyard apparatus for use in transferring loads in an elevated environment is disclosed. The fall protection lanyard may be connected to a load and used to safely transfer a human or nonhuman load in an elevated environment, such as from an airborne rotorcraft to an adjacent structure while providing fall protection for the load and emergency release capabilities for the aircraft. The lanyard apparatus provides total fall protection for the load throughout the transfer process without restricting or otherwise limiting available emergency flight options/maneuvers by incorporating an emergency release that automatically activates on demand. In a preferred embodiment, the fall protection lanyard apparatus includes first and second load-bearing lanyards, each terminating in a free end incorporating a connectable hook. The competing concerns of fall protection (for the load) and on-demand emergency release (for the aircraft) are each enabled by providing the first lanyard with an automatic quick release mechanism activated by a predetermined threshold force applied across the lanyard apparatus. The lanyard apparatus provides total fall protection during the transfer of a load to a structure in any elevated environment while providing an on-demand quick-release in emergency situations.

11 Claims, 5 Drawing Sheets

FALL PROTECTION LANYARD APPARATUS

CROSS REFERENCE TO RELATED APPLICATIONS

N/A

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights.

BACKGROUND OF THE INVENTION

1. Field of the Invention

The present invention relates generally to safety devices used for in fall protection, and, more particularly, to lanyard apparatus for use in providing fall protection for a load in an elevated environment.

2. Description of the Background Art

There are a number of basic devices, such as safety harnesses, for use in providing fall protection for loads in elevated environments. Safety harnesses, for example, commonly consist of shoulder straps attached to a waist or chest belt. Some harnesses incorporate suspender style straps with a tether point-of-attachment on the front center of the chest/waist strap. Others comprise a Y-shaped design, where the shoulder straps aare connected to a strap extending vertically from the waist belt to form a three-point intersection. These harnesses are typically constructed of nylon webbing, and commonly include padding. The harness is designed to support the load (i.e., body weight) by the torso and shoulders of the user for suspension from a helicopter. Sit harnesses comprise another category of HEL devices. Also known as pelvic harnesses, bosun's seat, rescue harnesses or rigger's harnesses, these devices suspend the user in a seated posture. The basic design of a sit harness includes a waist belt connected to leg loops routed around the top of the thighs. The point of the tether attachment typically extends directly in front of the upper pelvic region. Full-body harnesses (FBHs) comprise a combination of sit harnesses and chest harnesses. While there are a number of variations of the basic design of the harness, all full-body harnesses include leg loops, shoulder straps, and either a waist belt, a chest belt, or both.

One application wherein such safety devices are used involves the use of rotary winged aircraft, such as helicopters, in external load transfer operations. For example, human external load operations (HEL) typically involve the transportation of a passenger suspended by a cable assembly under the helicopter. For example, helicopters equipped with load suspension points, or hooks, are commonly used to transport loads in sling configuration wherein the load is suspended beneath the helicopter by a suspension apparatus. In other applications, helicopters carry cargo as well as human loads in various configurations external to the fuselage, such as on the skids or on skid-mounted platforms. For example, load-bearing platforms may be affixed to the helicopter to permit persons to operate external to the crew compartment. In other situations, a person may stand on one of the helicopter landing skids and operate in the external environment. HEL operations are commonly performed in transmission line maintenance and repair procedures in the electrical power industry, in the logging industry to access remote work sites, and for emergency rescue operations.

The present inventor has contributed significantly to safety advances in helicopter external load operations, particularly external human load operations. My U.S. Pat. No. 4,673,059 discloses a method and system for placing a load, which may consist of a combination of personnel and equipment, on or in proximity to components of an energized power transmission line. My U.S. Pat. No. 5,417,304 discloses a method for suspending a load from a rotary winged aircraft, such as a helicopter, using an apparatus that incorporates an emergency release activated by the suspended person.

In certain situations, however, it is necessary or desirable to transfer external loads from a hovering helicopter to a structure, such as a power transmission tower or an energized or de-energized power transmission line, ground wire, or other elevated point or structure. Neither the methods disclosed in the '059 and '034 patents, nor the background art, discloses a suitable safety apparatus for accomplishing the transfer of an external load from a hovering helicopter to an elevated stricture while maintaining adequate safeguards for both the helicopter as well as the load.

While my '304 patent discloses an emergency release for use with a suspended load, the system disclosed therein is a release-on-command type system that requires the suspended person to: (1) realize the existence of an emergency with the helicopter; and (2) manually activate the quick release to permit the helicopter to pull away. As should be apparent, the primary concerns in such human transfer applications involve maintaining adequate fall protection for the person during the transfer procedure without limiting helicopter operations, particularly the availability of emergency maneuvers and operations. It Is critical to maintain full fall protection for the person through the entire transfer process, while, at the same not limiting the operation of the helicopter in emergency situations.

Currently, there is little standardization and a general lack of safety procedures practiced by those performing HEL operations. While regulations exist regarding the physical and structural characteristics of external load operations, little consideration has been given to the issue of humans as external loads. Federal Aviation Regulations applicable to rotorcraft operations, particularly those referring to human external loads, are found in Title 14 of the Code of Federal Regulations (CFR). The collection of FAA regulations found in 14 CFR is often referred to as the Federal Aviation Regulations (FARs). Within 14 CFR, part 133 pertains directly to rotorcraft external load operations and contains subparts that address applicability, certification rules, operating rules, and related requirements. In addition, part 27 requires that any external load attaching means must include a quick-release system to enable the pilot to release the external load quickly during flight. While the regulations address a number of areas, they provide no specific detail regarding the attachment method, human load transfer methods, or the structure or function of quick-release devices.

As a result of the lack of adequate safety methods there have been a number of rotorcraft accidents in connection with HEL operations. During the period from 1973 through 1995, it has been reported that there were 473 external load operations in which the helicopters were involved in either an accident or an incident. Of the 473 accidents listed, a substantial number involved operations using a sling line or sling load. Accordingly, it is recognized that the predominant cause of external load accidents involves problems with the sling line/load.

One common, yet inherently risky prior art method of transferring an external human load from a hovering helicopter to a structure, in a non-sling configuration, consists of bringing the helicopter to a hover immediately adjacent to a structure, wherein the helicopter may be stabilized by the placement of one or both skids (or wheels) on the structure, thereby allowing the person to step from the helicopter to the structure. This method, however, is significantly flawed in that, to avoid tethering the helicopter to the structure and thereby limiting the availability of emergency flight procedures (e.g. emergency pull-away), there exist periods of time during the transfer that the person is without fall protection, and consequently at substantial risk.

Thus, although HEL operations have been practiced, there remains a need a safety lanyard apparatus for use in providing fall protection for loads in an external environment. More particularly there exists a need for an improved safety lanyard for use in HEL operations which is adapted to provide total fall protection for the load while preserving emergency operating procedures for the helicopter and crew by incorporating an emergency quick release.

BRIEF SUMMARY OF THE INVENTION

The present invention addresses the shortcomings of the background art by providing a fall protection lanyard apparatus for use in transferring loads in an elevated environment. The fall protection lanyard may be connected to a load and used to transfer the load from an airborne rotorcraft to a structure while providing fall protection and emergency release capabilities for the aircraft. The lanyard apparatus provides total fall protection for the load throughout the transfer process without restricting or otherwise limiting available emergency flight options/maneuvers by incorporating an emergency release that automatically activates on demand.

In a preferred embodiment, the fall protection lanyard apparatus includes first and second load-bearing lanyards, each terminating in a free end incorporating a hook. The competing concerns of fall protection (for the load) and on-demand emergency release (for the aircraft) are each enabled by providing the first lanyard with a quick release mechanism and the second lanyard with a limited slip mechanism.

Each lanyard is preferably attached to a common point, such as a load bearing steel O-ring, which in turn is attached to a safety harness which secures the load. The first lanyard incorporates a quick-release mechanism, which, upon activation, results in the separation of the hook and free end portion thereof. The second lanyard incorporates a limited slip mechanism, which, upon application of a predetermined force thereon, activates the first lanyard's quick-release mechanism. The lanyard apparatus provides total fall protection during the transfer of a load to a structure in any elevated environment while providing an on-demand quick-release in emergency situations.

The lanyard apparatus may be used to transfer of the load from the hovering aircraft to an adjacent structure by: (1) attaching the free end of the first lanyard to the helicopter; (2) attaching the free end of the second lanyard to the structure; (3) detaching the first lanyard from the helicopter; and (4) depositing the load onto the structure. When transferring from the structure to the helicopter the method is essentially reversed. When transferring loads as described, fall protection is provided since the load is safely tethered to a load bearing structure at all times. In addition, a quick release mechanism may be used to simultaneously provide an emergency release that allows the aircraft to instantly pull away without placing the external load at risk.

Accordingly, it is a primary object of the instant invention to provide an improved fall protection device.

Another object of the present invention is to provide a fall protection apparatus adapted to provide comprehensive fall protection for a person or thing in an elevated environment.

Still another object of the present invention is to provide a safety apparatus that provides fall protection for a human external load engaged in an airborne transfer, before, during, and after transfer to a structure.

Yet another object of the present invention is to provide a fall protection system for HEL operations that provides an emergency release for a helicopter tethered to a structure while transferring human and non-human loads to or from the structure.

Still another object of the present invention is to provide a fall protection system for HEL operations that permits for release of a tethered helicopter while transferring a load to or from the structure.

Another object of the present invention is to provide an apparatus for use in transferring loads from a hovering rotorcraft to a structure while providing total fall protection and incorporating an emergency release that does not require activation by the person being transferred.

In accordance with these and other objects, which will become apparent hereinafter, the instant invention will now be described with particular reference to the accompanying drawings.

DETAILED DESCRIPTION OF THE INVENTION

Figure 1:
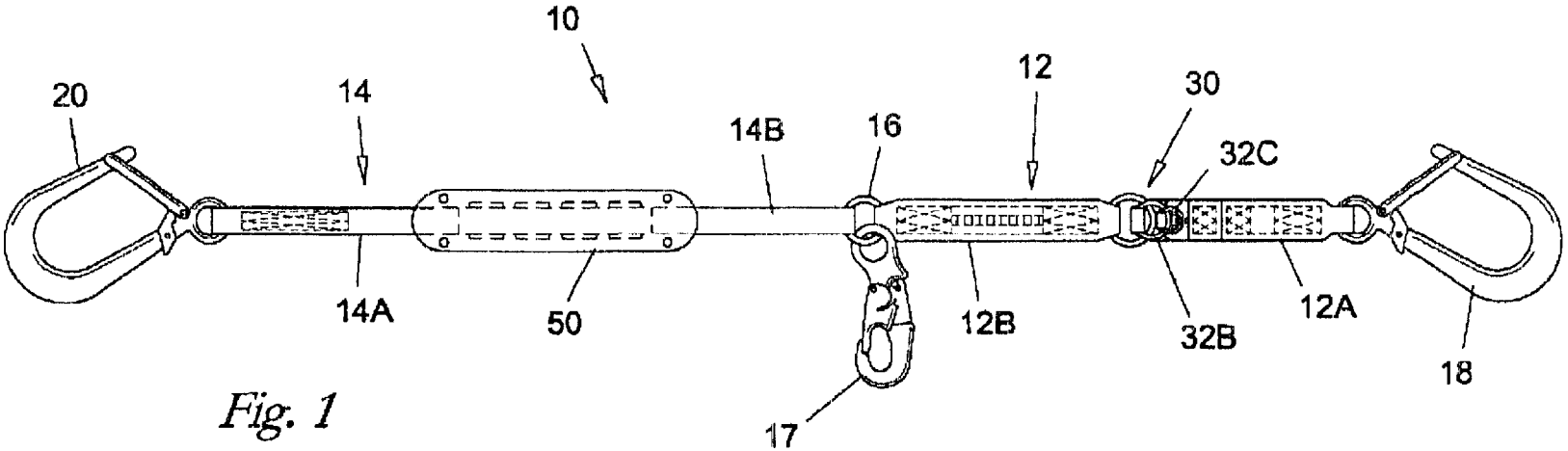
FIG. 1 depicts a top view of an emergency release lanyard apparatus according to the present invention.
Figure 2:
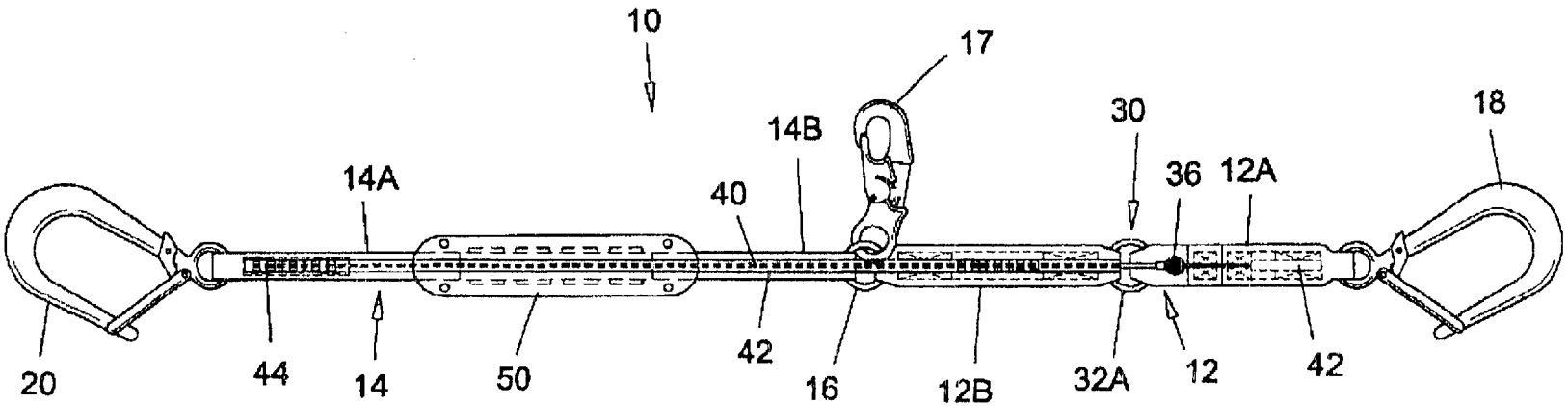
FIG. 2 depicts a bottom view thereof.
Figure 3:
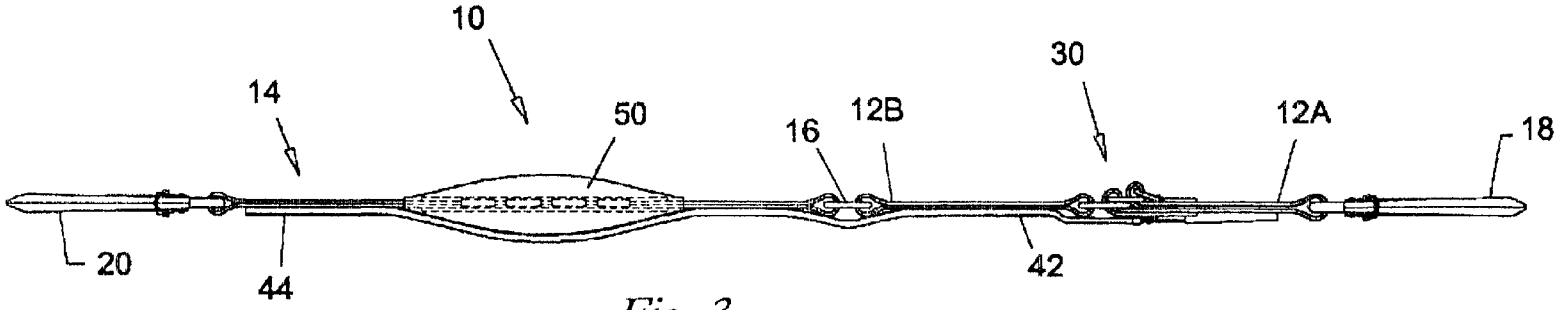
FIG. 3 depicts a side view thereof.
Figure 4:
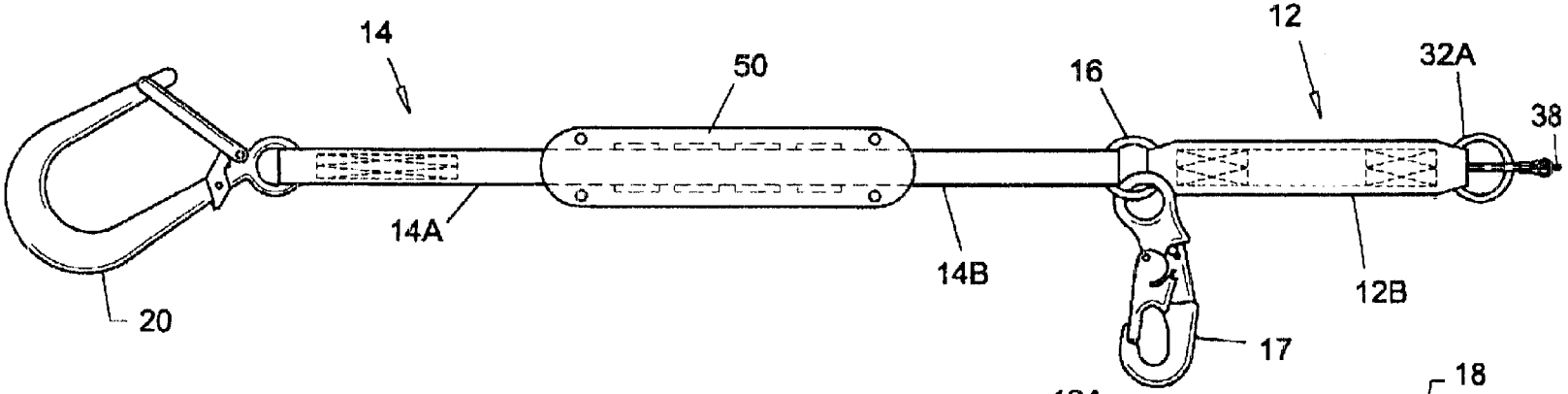
FIG. 4 depicts a top view thereof wherein the lanyard end portion is disconnected from the remaining portion of the apparatus.
Figure 4:
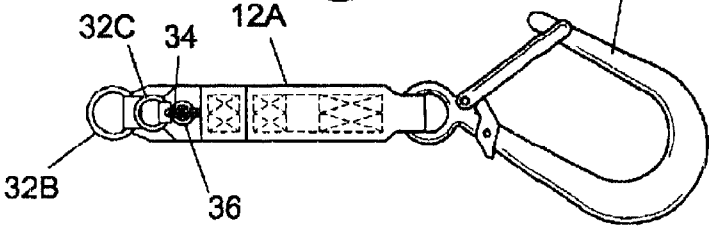
Figure 5A:
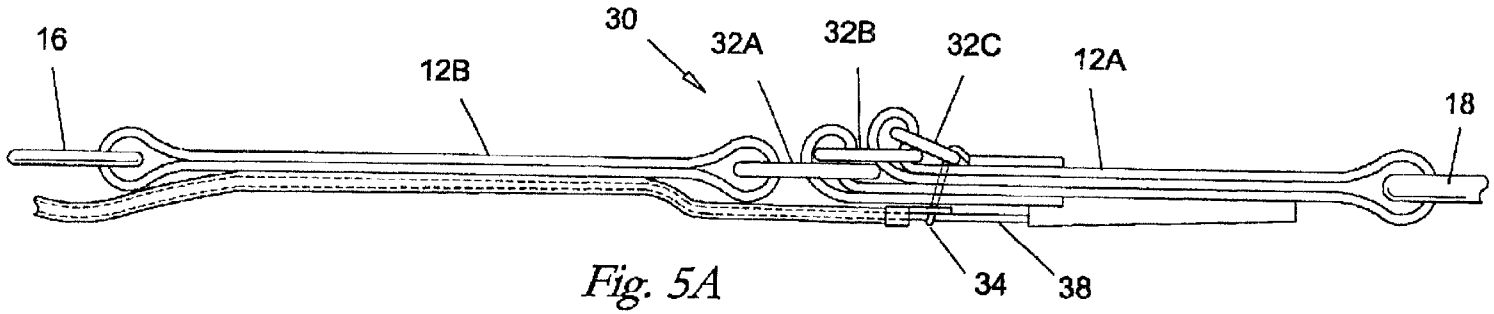
FIG. 5A is side detail view of a preferred embodiment emergency release mechanism for the lanyard apparatus in a connected configuration.
Figure 5B:
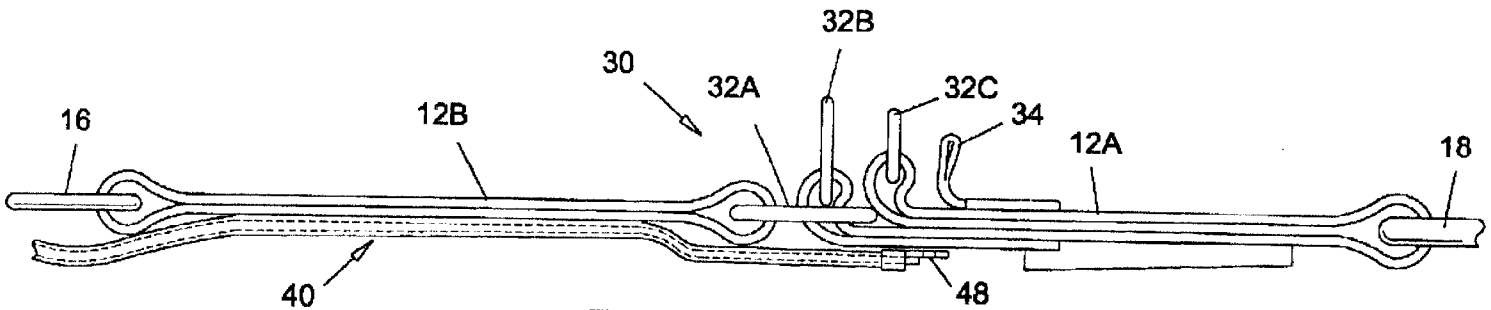
FIG. 5B is another side detail view thereof in a partially released configuration.
Figure 5C:
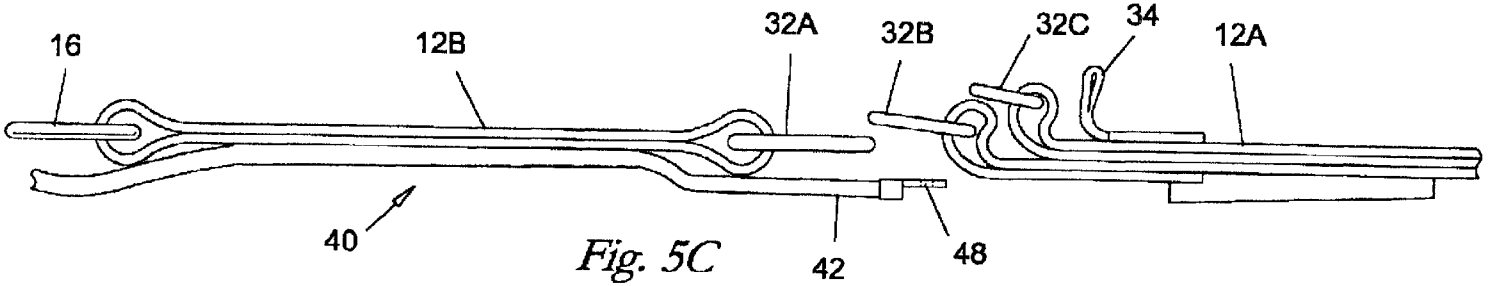
FIG. 5C is another side detail view thereof in a fully released configuration.
Figure 6A:
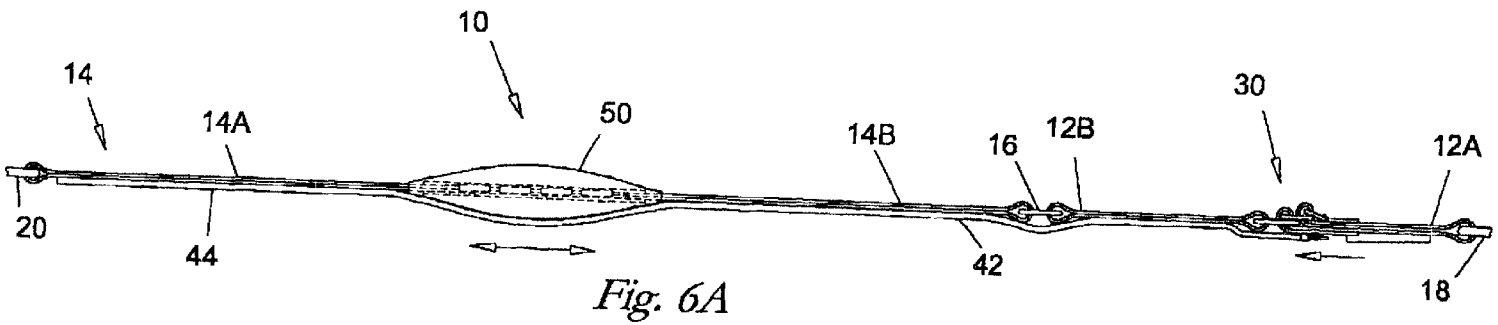
FIG. 6A is a partial side view of the lanyard apparatus illustrating activation of the emergency release mechanism by deployment of the limited slip mechanism.
Figure 6B:
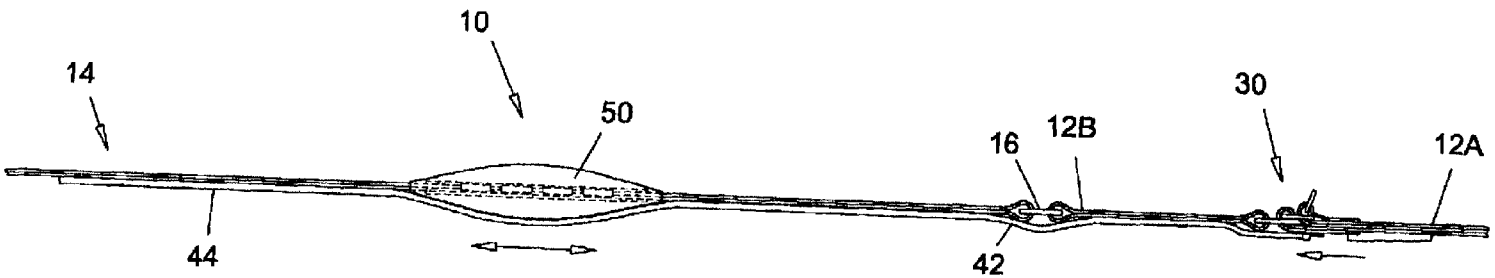
FIG. 6B is a partial side view thereof further illustrating activation of the emergency release mechanism.
Figure 5D:
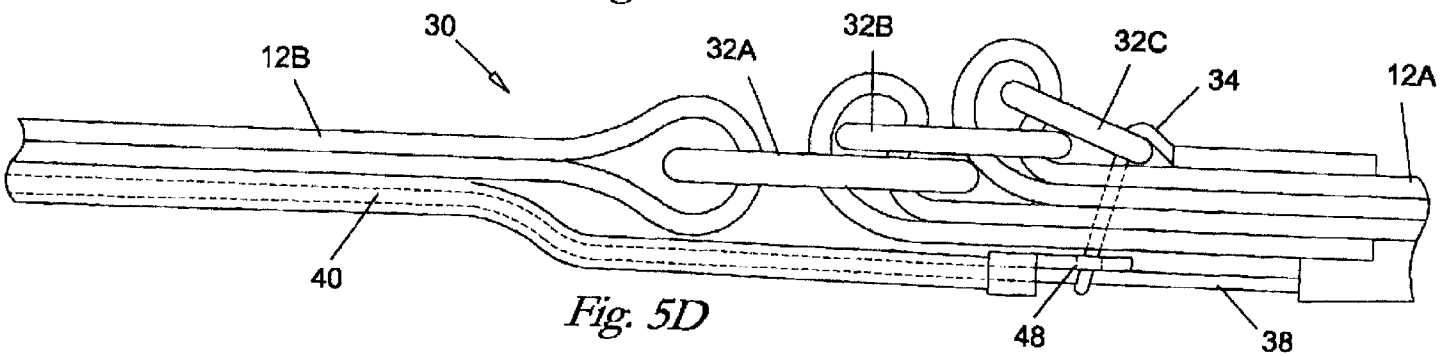
FIG. 5D is a detail view of the connecting mechanism shown in FIG. 5A.

With reference now to the drawings, there is illustrated a preferred embodiment of an emergency release lanyard apparatus according to the present invention for use in transferring a load in an elevated environment, for example, such as from a hovering helicopter to an elevated location on a structure. FIGS. 1 through 7B illustrate a fall protection lanyard, generally referenced as 10. Lanyard apparatus 10 includes a first lanyard 12 and a second lanyard 14, each connected to a load-bearing ring 16. Ring 16 provides a connection point for attaching the lanyard apparatus to the safety harness via a safety hook or other equivalent connecting device. The safety harness may be a personal safety harness worn by a human load, or a cargo harness attached to a non-human load. Lanyard segments 12 and 14 may be fabricated from any suitable, flexible load bearing material, such as nylon straps, rope, cable, or equivalent load bearing member. Each lanyard 12 and 14 terminates in a free end fitted with a safety hook, which hooks are referenced as 18 and 20 respectively. Hooks 18 and 20 are preferably locking type hooks, such as ladder hooks or snap hooks, having a double-action locking feature. The double-action locking mechanism is a safety feature that requires two separate and distinct manual acts to undo the hook thereby preventing the undesired or unintentional attachment/detachment of the hook. Hooks 18 and 20 are used to selectively attach the lanyard and load to points on a helicopter or structure during the transfer process as more fully disclosed herein. It should be noted, however, that the present invention contemplates that any suitable alternate means for connecting, such as clamps, may be substituted for hooks 18 and 20.

Lanyard 12 incorporates a quick release mechanism, generally referenced as 30, which is adapted for activation by a force applied the lanyard apparatus, and preferably to lanyard 14. Upon activation of the quick release mechanism the end portion of lanyard 12, generally referenced as segment 12A, is released from the remaining portion of the lanyard apparatus, and particularly released from lanyard segment 12, which remaining portion is generally referenced as segment 12B. Quick release mechanism 30 includes a releasable connection joining lanyard segments 12A and 12B. In a preferred embodiment, quick release mechanism 30 includes an interlocked series of rings, referenced as 32A, 32B and 32C, secured in an interlocked load-bearing configuration, joining lanyard segments 12A and 12B, by a loop 34 formed by parachute cord attached to one side of lanyard segment 12A and passing through a metal grommet 36 in lanyard segment 12A. Loop 34 is secured by a pin 38 removably inserted therethrough such that loop 34 secures rings 32A–C in a securely interlocked configuration capable of withstanding substantial loads. As best depicted in FIGS. 5A–5C and 6A and 6B, removal of pin 38 from loop 34 enables disconnection of lanyard segment 12A from segment 12B. Pin 38 is connected to a first end of a cable 40, which is preferably slidably received within a conduit 42 terminating in an eyelet 48, secured to lanyard segment 12B. Cable 40 includes a second end 44 that is connected to lanyard segment 14, and particularly end segment 14A. Movement of cable 40 causes the cable to retract relative to conduit 42 and loop 34 thereby displacing pin 38 from loop 34 and allowing separation of lanyard segment 12A from segment 12B by disengagement of rings 32A–C.

Lanyard 14 includes an end portion 14A that is connected to the remaining portion of lanyard 14, referenced as 14B, via a limited slip/shock absorbing mechanism, generally referenced as 50. Limited slip mechanism 50 allows for limited extension of lanyard 14 upon application of a predetermined force. In a preferred embodiment, the limited slip mechanism comprises a shock-absorbing lanyard, such as is available from Descent Control, Inc. of Fort Smith Ariz. and/or Miller Fall Protection Products, Inc. of Franklin, Pa., however any suitable limited slip mechanism is considered within the scope of the present invention. Upon application of a sufficient force, such as the force that would be encountered if the rotorcraft attempts to pull away in an emergency situation when tethered to the structure, the limited slip mechanism would activate thereby allowing the length of lanyard 14 to extend. In a preferred embodiment, a force in excess of 500 lbs. is required to activate the limited slip mechanism whereby an additional length of lanyard is deployed. Extension of lanyard 14 causes activation of the quick release mechanism on lanyard 12 as described hereinabove by movement of cable 40 and pin 38 from the interlinked ring assembly.

Figure 7A:
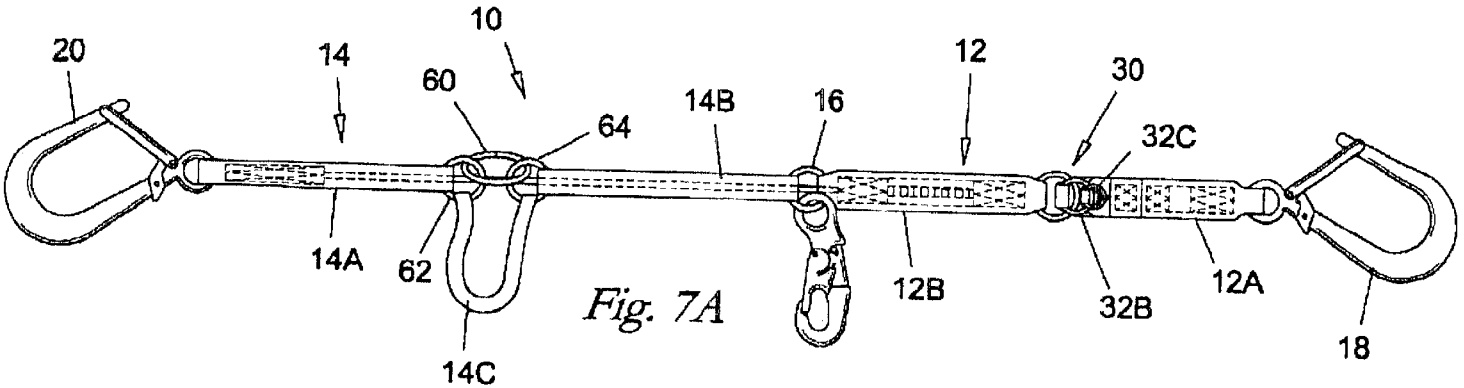
FIG. 7A is an alternate embodiment lanyard apparatus in a connected configuration with a breakaway link.
Figure 7B:
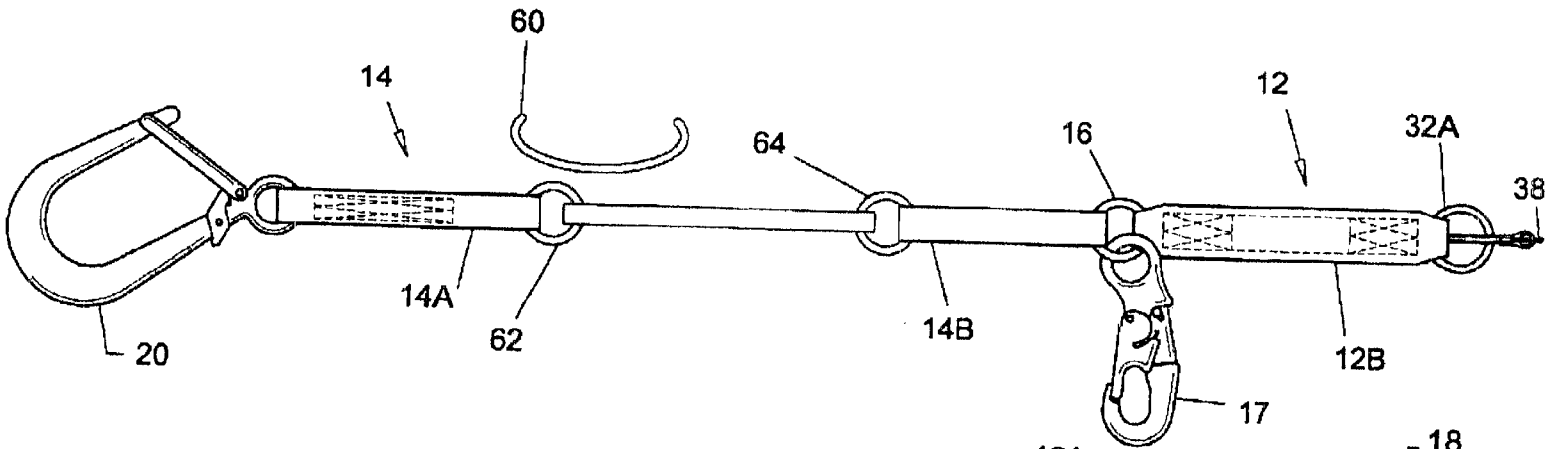
FIG. 7B is view thereof in a disconnected configuration.
Figure 7B:
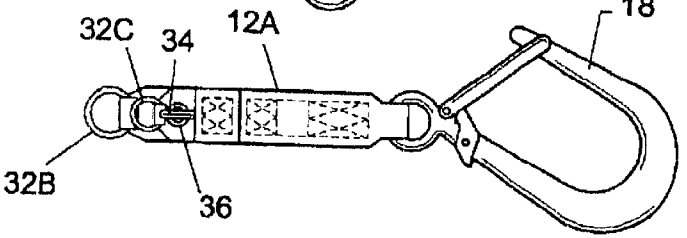

In an alternate embodiment depicted in FIGS. 7A and 7B, the limited slip mechanism may comprise a breakaway link 60 in combination with a third lanyard segment 14C joining lanyard segments 14A and 14B. In this embodiment, the breakaway link 60 joins segments 14A and 14B in close proximity by linked connection with additional rings 62 and 64 attached to the respective end portions of lanyard segments 14A and 14B. In addition, lanyard segment 14C has opposing ends connected to ring 62 and 64 respectively. Breakaway link 60 is selected such that application of a predetermined force thereto results in separation of the link and extension of lanyard 14 by the length of segment 14C. It should be noted, that any other suitable mechanism that allows for limited extension of lanyard 14 in response to the application of a force of a predetermined threshold value is considered within the scope of the present invention.

As previously noted, the second cable end 44 is connected to lanyard segment 14A. Accordingly, when a predetermined opposing force is applied to hooks 18 and 20, the limited slip mechanism 50 (or alternatively 60) activates thereby allowing lanyard 14 to extend. Extension of lanyard 14 causes cable 40 to slide within conduit 42 thereby removing pin 38 from loop 34. Once free, loop 34 no longer functions to maintain the connection between lanyard segments 12A and 12B thereby allowing the separation of lanyard section 12A from the remaining portions of the device 10. It should also be noted that the means for activating release 30, e.g. limited slip mechanism 50 or breakaway link 60, or an alternate means for activating release 30, may in an alternate embodiment, be incorporated on lanyard segment 12, and particularly on segment 12B, rather than on lanyard segment 14.

The emergency release lanyard apparatus disclosed herein may be used to safely l transfer a load in an elevated environment. For example, loads may be transferred from a first elevated platform, such as an airborne rotorcraft, to an adjacent elevated platform or structure while providing fall protection for the load and emergency release capabilities. Use of the fall protection lanyard 10 in an elevated environment requires secured attachment of the apparatus to the load and/or to a safety harness attached to the load, and safe transfer is accomplished by: (1) attaching the free end of lanyard 12 to the first elevated platform by attachment of hook 18; (2) releasing any auxiliary safety restraints; (3) attaching the free end of lanyard 14 to the second elevated platform by attachment of hook 20; (4) detaching lanyard 12 from the first elevated platform; and (5) depositing the load onto the second elevated platform. When transferring from the second elevated platform (e.g. tower) to the first elevated platform (e.g. helicopter) the method is essentially reversed.

The competing concerns of fall protection (for the load) and on-demand emergency release (for the aircraft) in HEL operations are each enabled by the emergency release lanyard 10. The lanyard apparatus provides total fall protection for the load throughout the transfer process without restricting or otherwise limiting available emergency flight options/maneuvers by incorporating an emergency release that automatically activates on demand. A significant aspect of the present invention in the HEL application involves maintaining complete fall protection for the load before, during, and after the transfer process without impairing the availability of emergency flight maneuvers for the helicopter as is the case with prior art methods. It should be noted that, with use of the fall protection lanyard disclosed herein, the load is protected from an accidental fall during all phases of the transfer. Specifically, fall protection may be initially provided by an FAA safety restraint (e.g. seat belt or equivalent cargo restraint). During the next step in the process wherein the first lanyard 12 is attached to the aircraft, fall protection is provided by secured attachment of the lanyard segment 12 to a load bearing point on the helicopter; after which the FAA restraint may be removed. During the next step in the process, wherein the second lanyard segment 14 is connected to the adjacent structure, fall protection is provided by the second lanyard segment. It should be noted, that during this phase of the transfer, e.g. when the first lanyard segment is attached to the helicopter and the second lanyard segment is attached to the structure, the helicopter is effectively tethered to the structure, and the load is tethered to both the helicopter and the structure. If an actual or perceived emergency dictates that the helicopter pilot execute an emergency pull-away maneuver, the lanyard apparatus is placed in tension. When the predetermined force is reached, the limited slip mechanism (50 or 60) of lanyard segment 14 activates thereby deploying an additional length of lanyard, which change in length activates the quick-release mechanism of lanyard segment 12 thereby releasing hook 18 and allowing the helicopter to depart while lanyard 14 functions to secure the load to the structure. In the absence of an emergency, hook 18 is detached from the helicopter and the load is secured to the structure by lanyard 14. It should be noted that the limited slip mechanism (50 or 60), or an alternate means for activating release 30, may in an alternate embodiment, be incorporated on lanyard segment 12, and particularly on segment 12B, rather than on lanyard segment 14.

Furthermore, the present invention may be used in a variety of applications that require the safe transfer of a load from one elevated point to another while providing fall protection.

The instant invention has been shown and described herein in what is considered to be the most practical and preferred embodiment. It is recognized, however, that departures may be made therefrom within the scope of the invention and that obvious structural and/or functional modifications will occur to a person skilled in the art.

What I claim is:

1. A safety apparatus for providing fall protection for an external human or non-human load connected thereto in an elevated environment, said safety apparatus comprising:

a load-bearing lanyard assembly, including connected first and second lanyard segments, each lanyard segment terminating in a free end portion, said first lanyard free end portion having means for selectively connecting to a first load supporting structure, said second lanyard free end portion having means for selectively connecting to a second supporting structure;

means, connected to each of said first and second lanyard segments, for connecting said load-bearing lanyard assembly to an external load;

said first lanyard segment including a releasable mechanical connection, said mechanical connection capable of being activated from a normally connected configuration wherein said free end portion thereof is connected thereto to a disconnected configuration wherein said free end portion thereof is disconnected therefrom;

means for activating said releasable mechanical connection from said connected configuration to said disconnected configuration in response to an a predetermined tensional force applied to said first and second lanyard free end portions.

2. A safety apparatus for providing fall protection for a load connected thereto in an elevated environment according to claim 1, wherein said means for activating said releasable mechanical connection in response to an applied predetermined force thereon includes a limited sup lanyard.

3. A safety apparatus for providing fall protection for a load connected thereto in an elevated environment according to claim 1, wherein said means for activating said releasable mechanical connection in response to an applied force thereon includes a breakaway link.

4. A safety apparatus for providing fall protection for human and non-human external loads in an elevated environment, said safety apparatus comprising:

a lanyard assembly including first and second connected lanyard segments, said first lanyard segment terminating in a first free-end portion, said second lanyard segment terminating in a second free-end portion;

means, disposed between said first and second free-end portions, for connecting said lanyard assembly to an external load;

said first free-end portion including means for connecting to a first load supporting structure said second free-end portion including means for connecting to a second load supporting structure;

said first lanyard segment including release means for releasing said free-end thereof upon activation of said release means; and said second lanyard segment including means for activating said release means in response to a tensional force exceeding a predetermined threshold value applied to said first and second lanyard free-ends.

5. A safety apparatus for providing fall protection for human and non-human loads in an elevated environment according to claim 4, wherein said means for selectively releasing said first lanyard free-end portion comprises a releasable mechanical connection releasably joining said first lanyard free-end portion to said first lanyard segment.

6. A safety apparatus for providing fall protection for human and non-human loads in an elevated environment according to claim 5, wherein said means for selectively releasing said first lanyard free-end portion comprises an interlocking three-ring mechanism activated by a slide-pin release mechanism.

7. A safety apparatus for providing fall protection for human and non-human loads in an elevated environment according to claim 4, wherein said means for activating said release means being responsive to an applied predetermined force applied to said lanyard free-ends includes a limited slip device, whereby said limited slip device is configured to activate said means for releasing upon deployment thereof.

8. A safety apparatus for providing fall protection for a load connected thereto in an elevated environment according to claim 4, wherein said means for activating said release means being responsive to an applied predetermined force thereon includes a breakaway link, whereby a predetermined threshold force is required to rupture said breakaway link thereby activating said release means.

9. A safety apparatus for providing fall protection for human and non-human loads in an elevated environment, said safety apparatus comprising:

a lanyard assembly including a first lanyard segment having a connectable free-end, a second lanyard segment having a connectable free-end, and a connection point for connection of a human or non-human external load;

said first lanyard connectable free-end adapted for connection to a first load supporting structure;

said second lanyard connectable free-end adapted for connection to a second load supporting structure;

means, disposed between said first and second connectable free ends, for connecting said first and second lanyards to a load;

said first lanyard segment including a quick-release mechanism capable upon activation for releasing said connectable free-end thereof; and means for activating said quick-release mechanism in response to a force exceeding a predetermined threshold value applied to said first and second lanyard ends.

10. A safety apparatus for providing fall protection for human and non-human loads in an elevated environment according to claim 9, wherein said means for activating said quick-release mechanism comprises a limited slip device.

11. A safety apparatus for providing all protection for human and non-human loads in an elevated environment according to claim 9, wherein said means for activating said quick-release mechanism comprises a break-away link.

* * * * *